US009049896B2

(12) United States Patent
Huh

(10) Patent No.: US 9,049,896 B2
(45) Date of Patent: Jun. 9, 2015

(54) DETACHABLE SAFETY GOGGLES FOR SAFETY HELMETS

(71) Applicant: OTOS TECH CO., LTD., Seoul (KR)

(72) Inventor: Moon Young Huh, Seoul (KR)

(73) Assignee: OTOS TECH CO., LTD. (KR)

( * ) Notice: Subject to any disclaimer, the term of this patent is extended or adjusted under 35 U.S.C. 154(b) by 273 days.

(21) Appl. No.: 13/905,217

(22) Filed: May 30, 2013

(65) Prior Publication Data

US 2013/0318673 A1 Dec. 5, 2013

(30) Foreign Application Priority Data

May 31, 2012 (KR) ..... 10-2012-0058512

(51) Int. Cl.
*A42B 3/04* (2006.01)
*A42B 3/18* (2006.01)

(52) U.S. Cl.
CPC ..... *A42B 3/0406* (2013.01); *A42B 3/185* (2013.01)

(58) Field of Classification Search
CPC ..... A42B 1/06; A42B 1/247; A42B 3/0406; A42B 3/185; G02C 3/02; G02C 5/14; G02C 5/20; G02C 5/22; G02C 5/30
USPC ..... 2/210, 13, 209.13, 417, 418, 422, 426; 351/155
See application file for complete search history.

(56) References Cited

U.S. PATENT DOCUMENTS 2,511,234 A * 6/1950 Anderson ..... 2/8.1
3,214,809 A * 11/1965 Edwards ..... 24/68 B
3,325,824 A * 6/1967 Donegan ..... 2/8.1
3,444,560 A * 5/1969 Northup, Jr ..... 2/8.1
3,907,410 A * 9/1975 Richmond et al. ..... 351/119
4,017,165 A * 4/1977 Davis ..... 351/153
4,153,348 A * 5/1979 Walters et al. ..... 351/118
4,792,221 A * 12/1988 Parks et al. ..... 351/120
4,856,109 A * 8/1989 Desy et al. ..... 2/9
4,999,846 A * 3/1991 Ball et al. ..... 2/5
5,129,102 A * 7/1992 Solo ..... 2/10
5,261,124 A * 11/1993 Day ..... 2/10
5,289,592 A * 3/1994 Paivarinta ..... 2/431
5,357,654 A * 10/1994 Hsing-Chi ..... 24/68 B
5,471,259 A * 11/1995 Cahill ..... 351/155
5,533,208 A * 7/1996 Tonoyan et al. ..... 2/10
5,689,827 A * 11/1997 Ryder ..... 2/10
5,692,234 A * 12/1997 Yuen ..... 2/10
5,778,448 A * 7/1998 Maher ..... 2/10
5,987,640 A * 11/1999 Ryder ..... 2/10
6,237,147 B1 * 5/2001 Brockman ..... 2/10
6,293,673 B1 * 9/2001 Hirschman et al. ..... 351/123

(Continued)

*Primary Examiner* — Clinton T Ostrup
*Assistant Examiner* — Anne Kozak
(74) *Attorney, Agent, or Firm* — Cantor Colburn LLP

(57) ABSTRACT

Disclosed are detachable safety goggles for safety helmets including a frame provided with rack gears formed at both leg parts thereof, inner housings allowing the leg parts to enter and exit the inner housings and provided with first snap protrusions, outer housings allowing the leg parts to enter and exit the outer housings and provided with first snap gears, rotating handles combined with the outer housings and provided with pinion gears corresponding to the rack gears, and holders combined with the upper ends of the outer housings and combined with the frame of a safety helmet. The detachable safety goggles for safety is detachably attached to the safety helmet, and the wearing distance and angle of the goggles with a worker may be conveniently adjusted as the worker desires.

6 Claims, 8 Drawing Sheets

(56) References Cited

U.S. PATENT DOCUMENTS

| | | | | |
|---|---|---|---|---|
| 6,314,588 | B1 * | 11/2001 | Fang | 2/418 |
| 6,397,396 | B1 * | 6/2002 | Vibert | 2/209.13 |
| 6,454,406 | B1 * | 9/2002 | Guo | 351/120 |
| 6,490,729 | B1 * | 12/2002 | Dondero | 2/10 |
| 6,491,390 | B1 * | 12/2002 | Provost | 351/155 |
| 6,708,376 | B1 * | 3/2004 | Landry | 24/68 R |
| 6,807,679 | B1 * | 10/2004 | Wang-Lee | 2/10 |
| 6,837,579 | B1 * | 1/2005 | Chen | 351/120 |
| 6,892,393 | B1 * | 5/2005 | Provost et al. | 2/10 |
| 6,935,741 | B2 * | 8/2005 | Denney | 351/155 |
| 7,000,262 | B2 * | 2/2006 | Bielefeld | 2/418 |
| 7,147,323 | B1 * | 12/2006 | Wu | 351/155 |
| 7,172,284 | B1 * | 2/2007 | Sasaki | 351/155 |
| 7,174,575 | B1 * | 2/2007 | Scherer | 2/418 |
| 7,207,673 | B1 * | 4/2007 | Ho | 351/155 |
| 7,448,092 | B2 * | 11/2008 | Wu | 2/171 |
| 7,866,813 | B2 * | 1/2011 | Anhalt | 351/155 |
| 7,896,491 | B1 * | 3/2011 | Lin | 351/120 |
| 7,926,938 | B2 * | 4/2011 | Lu | 351/155 |
| 8,015,625 | B2 * | 9/2011 | Grim et al. | 2/420 |
| 8,032,993 | B2 * | 10/2011 | Musal | 24/68 B |
| 8,161,576 | B2 * | 4/2012 | Lemke et al. | 2/418 |
| 8,214,921 | B2 * | 7/2012 | Grad et al. | 2/9 |
| 8,434,168 | B2 * | 5/2013 | Paulson | 2/427 |
| 8,578,521 | B2 * | 11/2013 | Rogers et al. | 2/417 |
| 8,677,517 | B1 * | 3/2014 | Morency et al. | 2/424 |
| 2002/0085171 | A1 * | 7/2002 | Wang-Lee | 351/120 |
| 2005/0078273 | A1 * | 4/2005 | Holm | 351/155 |
| 2005/0160511 | A1 * | 7/2005 | Kim | 2/10 |
| 2006/0055875 | A1 * | 3/2006 | Yang | 351/120 |
| 2006/0080761 | A1 * | 4/2006 | Huh | 2/424 |
| 2006/0221297 | A1 * | 10/2006 | Tsai | 351/41 |
| 2009/0235437 | A1 * | 9/2009 | Springer et al. | 2/422 |
| 2009/0313745 | A1 * | 12/2009 | Kang et al. | 2/424 |
| 2010/0095438 | A1 * | 4/2010 | Moelker | 2/418 |
| 2010/0154093 | A1 * | 6/2010 | Provost et al. | 2/10 |
| 2011/0088148 | A1 * | 4/2011 | Chen | 2/418 |
| 2011/0154551 | A1 * | 6/2011 | Spink | 2/10 |
| 2012/0204330 | A1 * | 8/2012 | Albouy | 2/421 |
| 2012/0281429 | A1 * | 11/2012 | Orozco et al. | 362/572 |
| 2012/0291173 | A1 * | 11/2012 | Gleason et al. | 2/10 |
| 2014/0013480 | A1 * | 1/2014 | Treger et al. | 2/10 |
| 2015/0059064 | A1 * | 3/2015 | Klotz et al. | 2/417 |
| 2015/0085243 | A1 * | 3/2015 | Wu | 351/114 |

* cited by examiner

DETACHABLE SAFETY GOGGLES FOR SAFETY HELMETS

BACKGROUND OF THE INVENTION

1. Field of the Invention

The present invention relates to detachable safety goggles for safety helmets which may be used while being detachably attached to a safety helmet.

2. Description of the Related Art

For the sake of safety during operations at various industrial sites, workers wear safety helmets. In general, a safety helmet is not equipped with safety goggles for convenience of an operation. Therefore, when a worker wearing a safety helmet that is not equipped with safety goggles performs operations, the worker may not open his/her eyes or hurt his/her eyes due to intense light or flying foreign debris.

Therefore, a safety helmet equipped with safety goggles may be provided. In this case, the safety goggles are formed in a screen type shielding the entirety of the face of a worker, and both sides of the safety goggles are shaft-coupled with both sides of the safety helmet. Therefore, in case of such a safety helmet, attaching/detaching of the safety goggles to/from the safety helmet may be difficult, and use of safety goggles may be inconvenient due to the large size of the safety goggles.

In order to solve such inconvenience, a worker may separately wear sunglass-type safety goggles. In this case, the safety goggles may cause inconvenience due to sweat or the worker may repeatedly put on and take off the safety goggles.

SUMMARY OF THE INVENTION

Therefore, the present invention has been made in view of the above problems, and it is an object of the present invention to provide detachable safety goggles for safety helmets which may be used while conveniently adjusting the distance and angle of the detachable safety goggles with the eyes of a worker according to conditions of the worker.

It is another object of the present invention to provide detachable safety goggles for safety helmets which may rotate lens upward and downward.

In accordance with an aspect of the present invention, the above and other objects can be accomplished by the provision of detachable safety goggles for safety helmets including a frame provided with a lens mounted at the front part thereof and rack gears formed in the forward and backward directions at both leg parts thereof, inner housings, each of which is formed in a cylindrical shape, at least one end surface of which is opened, and is provided with first holes formed through the side surface thereof so that each of leg parts may enter and exit each of the inner housings through the first holes, and first snap protrusions formed on the inner surface contacting the at least one opened end surface, outer housings, each of which is formed in a cylindrical shape, one end surface of which is closed and the other end surface of which is opened, and is provided with second holes formed through the side surface thereof so that each of the leg parts combined with the first holes may enter and exit each of the outer housings through the second holes and be rotated by a designated angle upward and downward, and a first snap gear corresponding to the first snap protrusions of each of the inner housings and formed on the closed end surface, a rotation shaft hole being formed through the center of the first snap gear, rotating handles, each of which is combined with the rotation shaft hole of each of the outer housings and is provided with a pinion gear formed at the end thereof inserted into each of the outer housings so as to be engaged with each of the rack gears, and holders, each of which is combined with the upper end of each of the outer housings and is combined with the frame of a safety helmet.

A coupling unit to combine each of the outer housings and each of the holders may include a rotating protrusion formed in a flat disc shape by cutting both sides of a sphere, and a rotating hole provided with a spherical inner space corresponding to the rotating protrusion.

A second snap gear may be combined with the center of the front part of the frame, rotating shafts may be formed at both sides of the second snap gear, and a mounting member including slots formed at both sides of the front part of the mounting member so that the lens may be inserted into the slots, rings formed at both sides of the rear part of the mounting member and inserted into the rotating shafts so as to be rotated, and a second snap protrusion corresponding to the second snap gear and formed between the rings may be provided.

The mounting member may further include a groove formed between the rings, a coil spring inserted into the groove, and a pusher provided with a second snap protrusion formed on the rear end surface thereof pusher under the condition that the pusher is inserted into the groove.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE INVENTION

Figure 1:
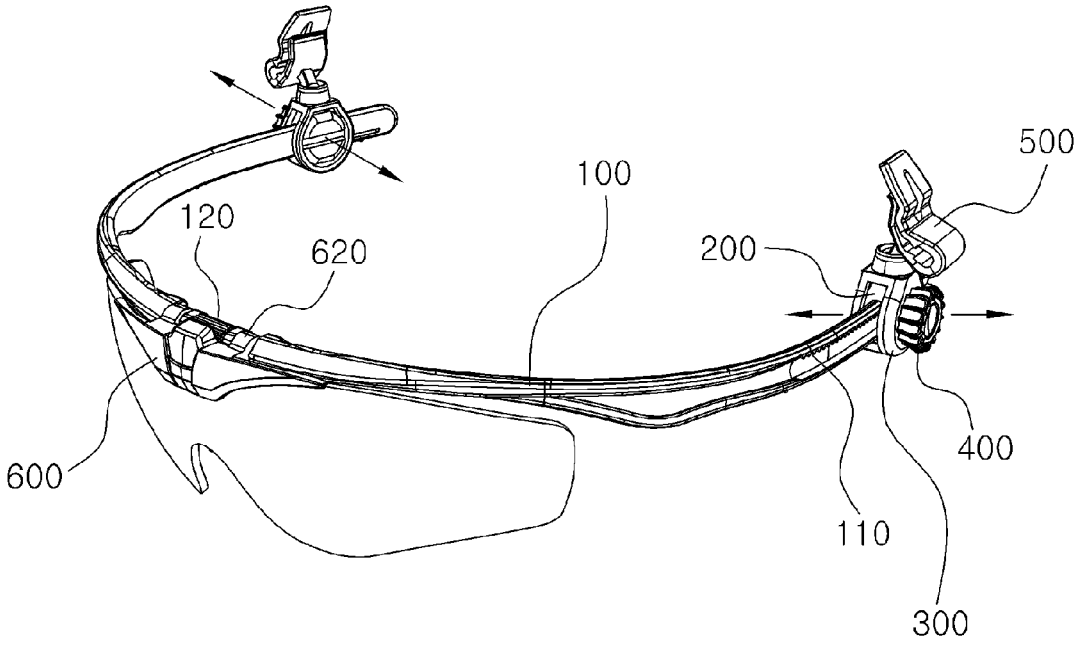
FIG. 1 is a perspective view illustrating detachable safety goggles for safety helmets in accordance with one embodiment of the present invention.

Now, preferred embodiments in accordance with the present invention will be described in detail with reference to the annexed drawings.

Detachable safety goggles for safety helmets in accordance with one embodiment of the present invention, as exemplarily shown in FIGS. 1 to 8, include a frame 100 provided with rack gears 110 formed at both leg parts thereof, inner housings 200 provided with first snap protrusions 220 so that the leg parts enter and exit the inner housings 200, outer housings 300 provided with first snap gears 320 corresponding to the first snap protrusions 220 and accommodating the inner housings 200 so that the leg parts enter and exit the outer housings 300, rotating handles 400 combined with the outer housings 300 and provided with pinion gears 410 corresponding to the rack gears 110, and holders 500 combined with the upper ends of the outer housings 300 and fixed to the frame of a safety helmet.

A lens L is mounted at the front part of the frame 100, and the rack gears 110 are arranged in the forward and backward directions at both leg parts of the frame 100. Although the embodiment shown in FIG. 1 illustrates the part of the frame 100 where the lens L is mounted and the leg parts of the frame 100 as being formed integrally, the part of the frame 100 where the lens L is mounted and the leg parts of the frame 100 may be separately formed and then connected by hinges.

Figure 2:
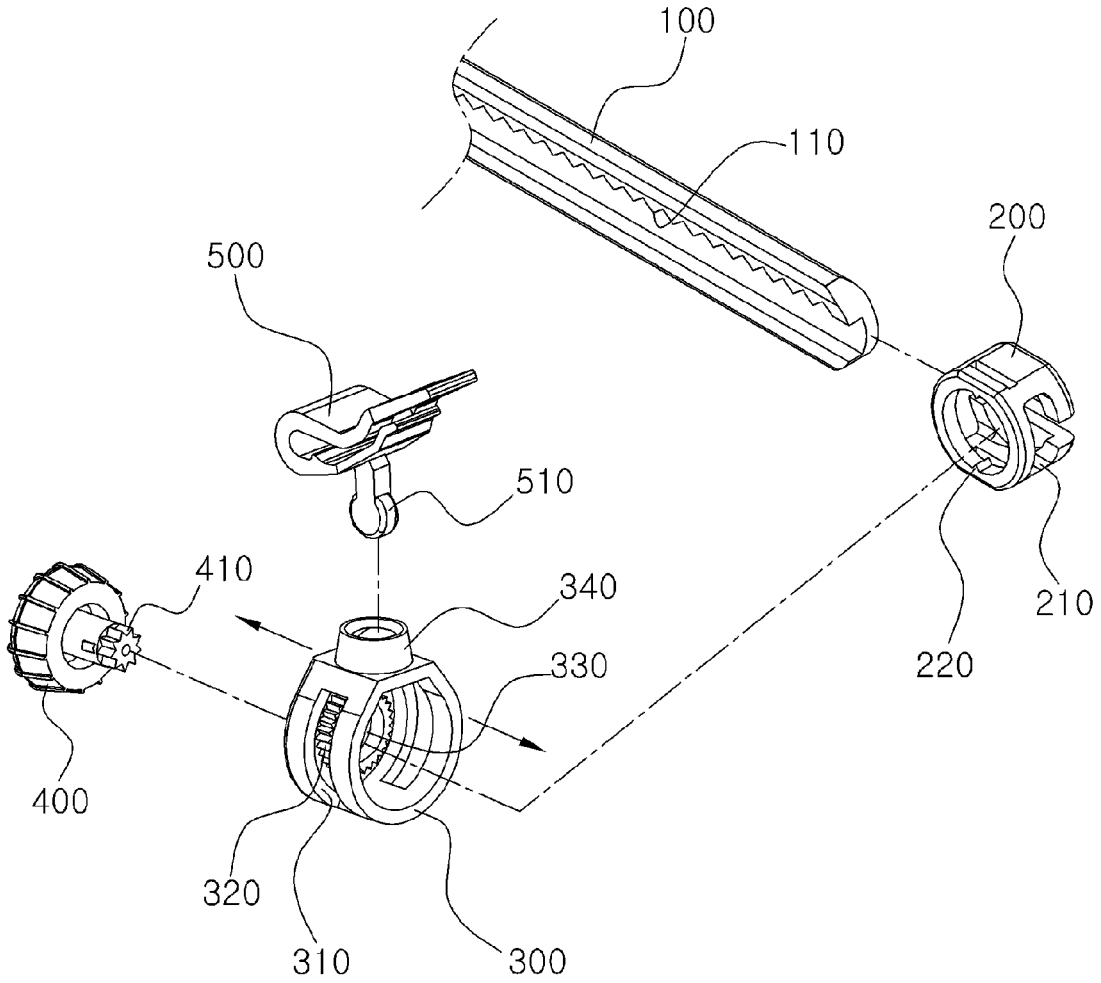
FIG. 2 is an exploded perspective view illustrating a first essential portion of the detachable safety goggles for safety helmets in accordance with the embodiment of the present invention.
Figure 3:
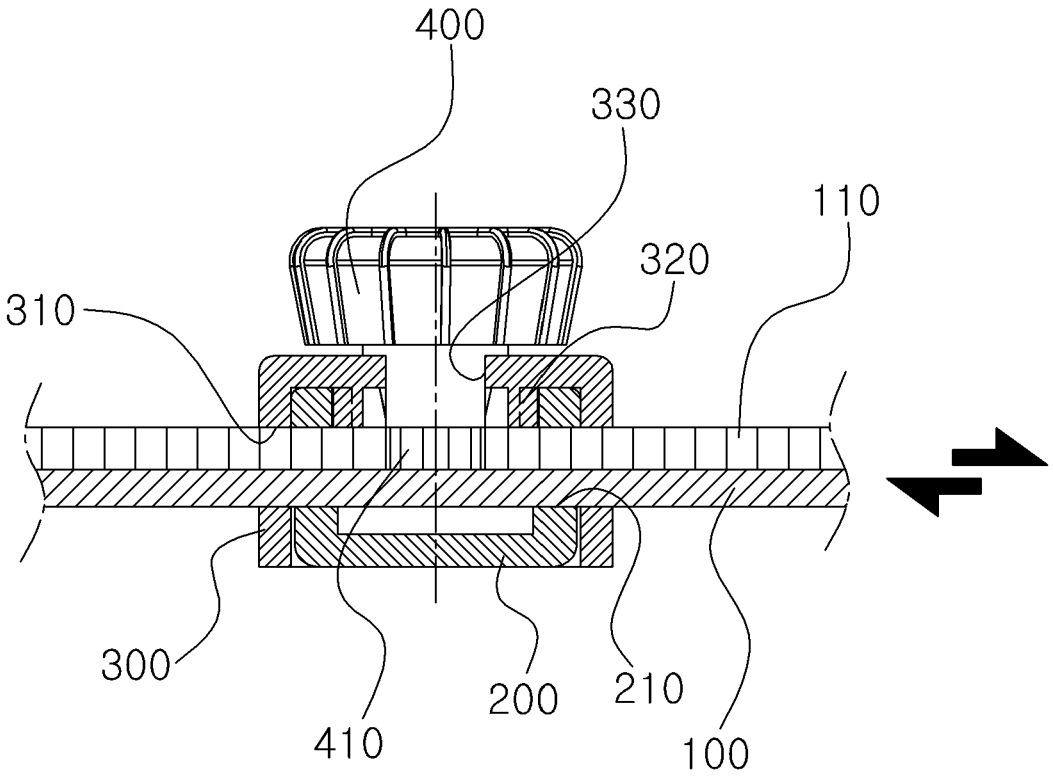
FIG. 3 is a longitudinal-sectional view illustrating the first essential portion of the detachable safety goggles for safety helmets in accordance with the embodiment of the present invention.
Figure 4:
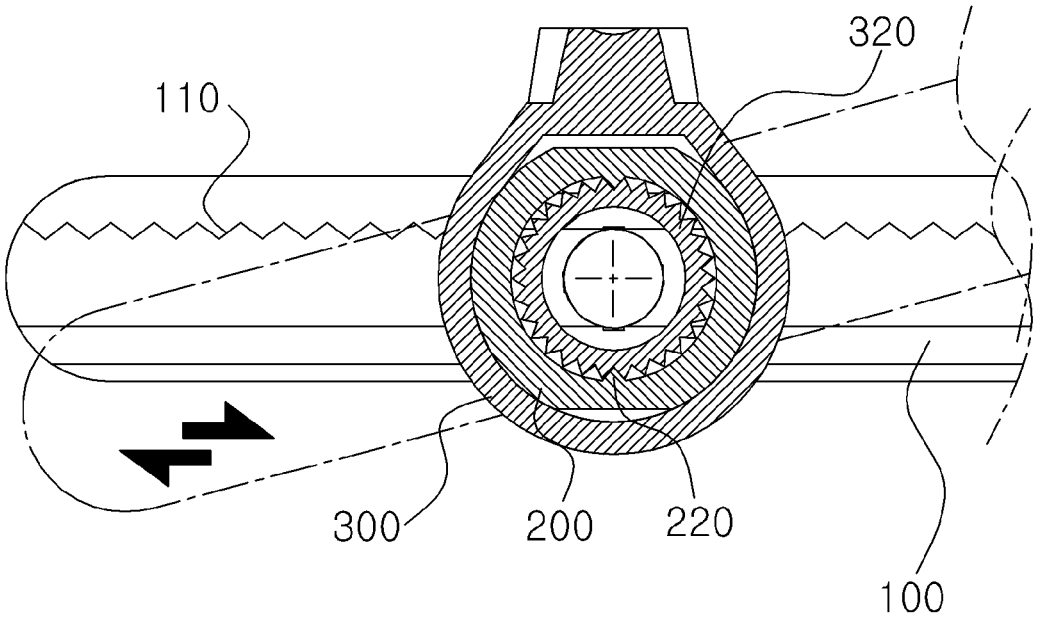
FIGS. 4 and 5 are transversal-sectional views illustrating the first essential portion of the detachable safety goggles for safety helmets in accordance with the embodiment of the present invention.
Figure 5:
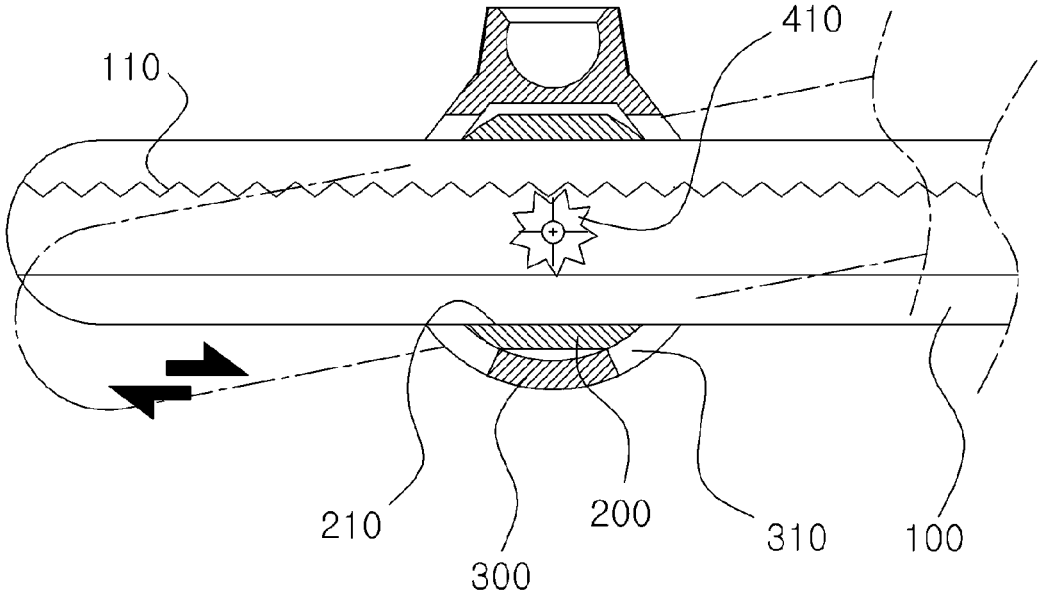
Figure 6:
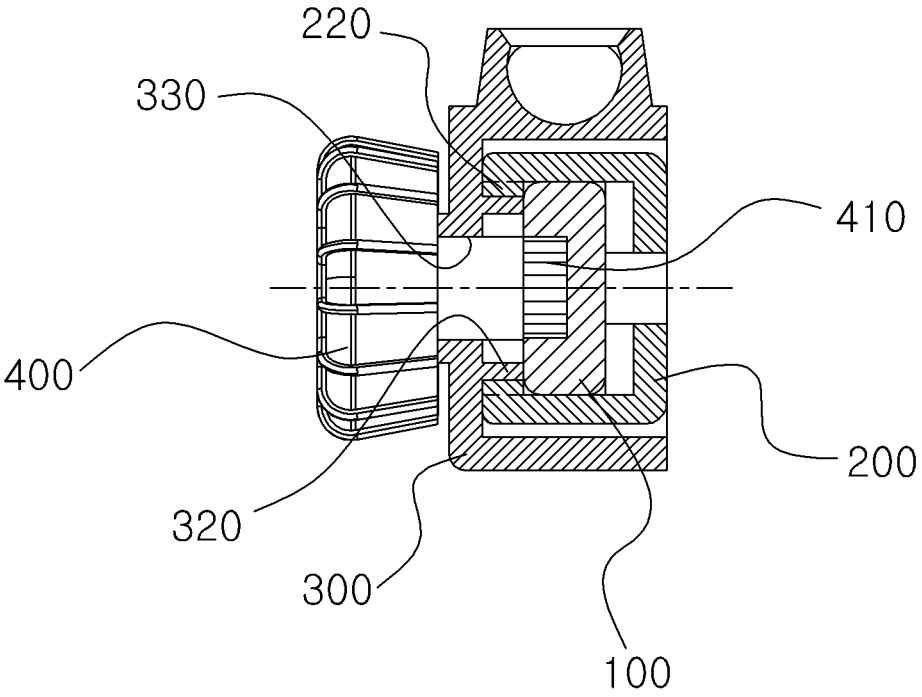
FIG. 6 is a longitudinal-sectional view illustrating the first essential portion of the detachable safety goggles for safety helmets in accordance with the embodiment of the present invention.
Figure 7:
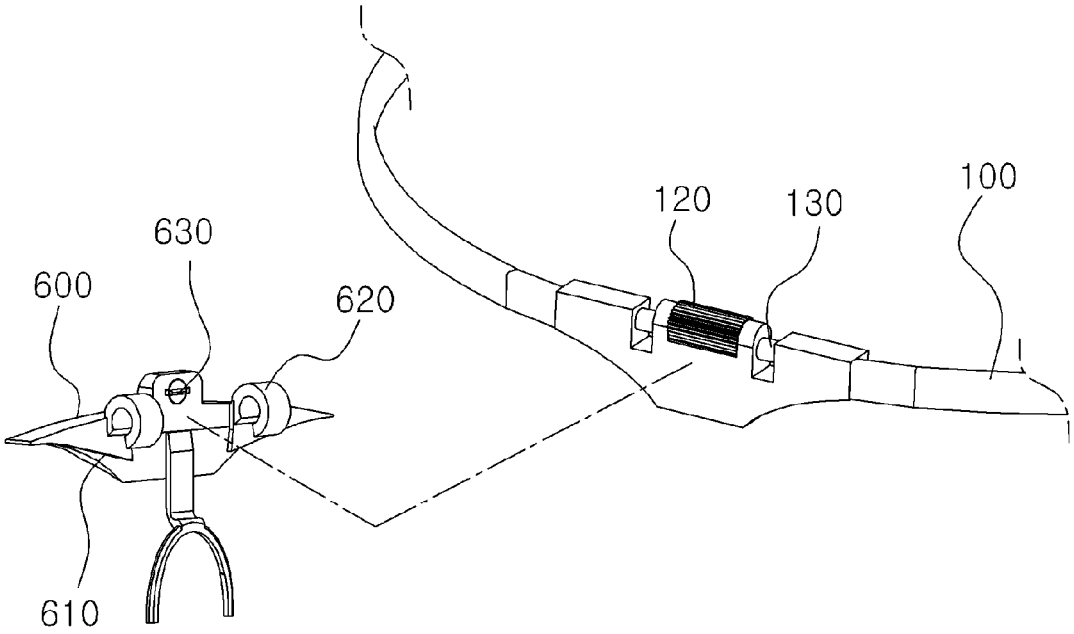
FIG. 7 is an exploded perspective view illustrating a second essential portion of the detachable safety goggles for safety helmets in accordance with the embodiment of the present invention.
Figure 8:
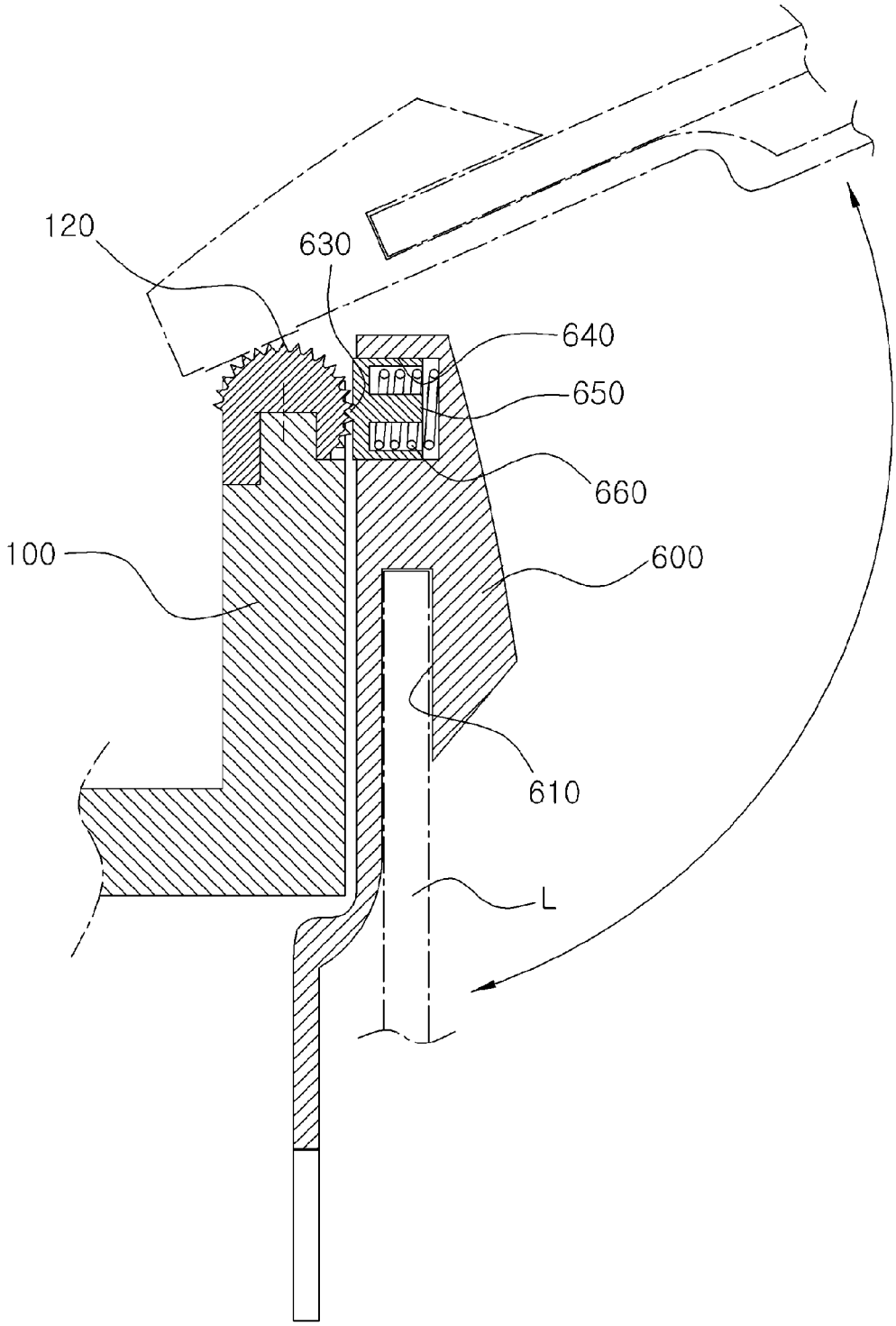
FIG. 8 is a longitudinal-sectional view illustrating the second essential portion of the detachable safety goggles for safety helmets in accordance with the embodiment of the present invention.

The rack gear 110 is engaged with the pinion gear 410 of the rotating handle 400, which will be described later, and serves to adjust the wearing distance between the eyes of a wearer and the safety goggles. From the viewpoint of characteristics, the rack gear 110 is formed on the outer surface of the leg part for the sake of wearer comfort and, in this case, the rack gear 110 may be formed on the upper or lower region of the outer surface of the leg part, or be formed on both the upper and lower regions of the outer surface of the leg part. Further, although FIGS. 1 and 2 illustrate the rack gear 110 as being formed at the upper end of a groove formed on the outer surface of the leg part, the rack gear 110 may be protruded from the outer surface of the leg part, as needed.

The leg part is inserted into the inner housing 200 so as to be combined with the inner housing 200. The inner housing 200 is formed in a cylindrical shape, at least one end surface is opened, first holes 210 are formed through the side surface of the inner housing 200 so that the leg part may enter and exit the inner housing 200 through the first holes 210, and the first snap protrusions 220 are formed on the inner side surface contacting the opened end surface of the inner housing 200. Therefore, the inner housing 200 may move forward and backward under the condition that the leg part is combined with the inner housing 200 and thus the wearing distance between the eyes of the wearer and the safety goggles may be adjusted, and the inner housing 200 may rotated upward and downward under the condition that the inner housing 200 is inserted into the outer housing 300, which will be described later, and thus the wearing angle of the safety goggles may be adjusted.

The inner housing 200 is inserted into the outer housing 300 so as to be combined with the outer housing 300, and the outer housing 300 restricts the rotating angle of the inner housing 200. The outer housing 300 is formed in a cylindrical shape, one end surface of which is closed and the other end surface of which is opened, second holes 310 are formed through the side surface of the outer housing 300 so that the leg part combined with the first holes 210 may enter and exit the outer housing 300 through the second holes 310 and be rotated by a designated angle upward and downward, and the first snap gear 320 corresponding to the first snap protrusions 220 of the inner housing 200 is formed on the closed end surface of the outer housing 300. Further, a rotation shaft hole 330 is formed through the center of the snap gear 320 so that the rotating handle 400, which will be described later, may be combined with the rotation shaft hole 330. Therefore, if the wearing distance between the eyes of the wearer and the safety goggles is adjusted, the leg part enters and exits the outer housing 300 through the second holes 310 corresponding to the first holes 210, and if the wearing angle of the safety goggles is adjusted, the leg part contacts the upper ends or the lower ends of the second holes 310 and is thus restricted to a designated angle.

The rotating handle 400 serves to adjust the wearing distance between the eyes of the wearer and the safety goggles and is combined with the rotation shaft hole 330 of the outer housing 300, and the pinion gear 410 engaged with the rack gear 110 of the leg part is formed at the end of the rotating handle 400 inserted into the outer housing 300. Therefore, when the rotating handle 400 is rotated, the leg part moves forward and backward through the rack gear 110 engaged with the pinion gear 410, and thereby, the wearing distance between the eyes of the wearer and the safety goggles may be adjusted. In order to prevent the rotating handle 40 from being released from the outer housing 300, the rotating handle 400 includes a hook fastened to the rotation shaft hole 330, as exemplarily shown in FIGS. 2 and 3.

The holder 500 serves to detachably attach the outer housing 300 to the frame of a safety helmet, and is combined with the upper end of the outer housing 300. Therefore, in accordance with the embodiment, as exemplarily shown in FIGS. 1 and 2, the holder 500 may have a bent clip form so that the holder 500 is not removed from the frame of the safety helmet after the holder 500 is fitted into the frame of the safety helmet.

The outer housing 300 and the holder 500 are combined with each other by a coupling unit. As exemplarily shown in FIGS. 1 and 2, the coupling unit includes a rotating protrusion 510 formed in a flat disc shape by cutting both sides of a sphere, and a rotating hole 340 provided with a spherical inner space corresponding to the rotating protrusion 510. Here, the rotating protrusion 510 may be formed on one of the outer housing 300 and the holder 500 and the rotating hole 340 may be formed on the other of the outer housing 300 and the holder 500. For example, FIG. 2 illustrates the rotating hole 340 as being formed at the upper end of the outer housing 300, and the rotating protrusion 510 as being formed at the lower end of the holder 500.

Further, the coupling unit to combine the outer housing 300 and the holder 500 is configured such that the outer housing 300 may be rotated in the leftward and rightward directions (in the inward and outward directions of the safety helmet) so as to correspond to the size and shape of the safety helmet.

Here, rotation does not mean rotation about one shaft, but means rotation about one pivot point. Therefore, the coupling unit may adjust tilt and horizontality as well as rotating angle.

The detachable safety goggles for safety helmets in accordance with the embodiment of the present invention may be configured such that the lens L mounted on the frame 100 may be rotated upward and downward so as to be opened and closed. In accordance with the embodiment of the present invention, as exemplarily shown in FIGS. 1, 7, and 8, a second snap gear 120 is combined with the center of the front part of the frame 100, rotating shafts 130 are formed at both sides of the second snap gear 120, and a mounting member 600 is provided. The mounting member 600 includes slots 610 formed at both sides of the front part of the mounting member 600 so that the lens L may be inserted into the slots 610, rings 620 formed at both sides of the rear part of the mounting member 600 and inserted into the rotating shafts 130 so as to be rotated, and a second snap protrusion 630 corresponding to the second snap gear 120 and formed between the rings 620. Therefore, the mounting member 600 may be rotated upward and downward by the rotating shafts 130 and the rings 620, and maintain a rotating angle by the second snap gear 120 and the second snap protrusion 630.

In this case, a groove 640 is formed between the left and right rings 620 of the mounting member 600, and a coil spring 650 inserted into the groove 640 and a pusher 660 provided with a second snap protrusion 630 formed on the rear end surface thereof under the condition that the pusher 660 is inserted into the groove 640 are provided, thereby more stably rotating the lens L and maintaining the rotating angle of the lens L using elastic force of the coil spring 650 between the second snap protrusion 630 and the second snap gear 120.

In accordance with another embodiment of the present invention, the legs of the detachable safety goggles for safety helmets are not protruded to the outside and are curved in the inward direction of the head of a wearer so as to be bent in the same shape as the head of the wearer, as shown in the drawings, thus preventing the safety goggles from encumbering the wearer during operation. That is, the detachable safety goggles for safety helmets may be configured as detailed bellow.

Both leg parts of the frame 100 provided with the rack gears 110 are curved in the inward direction of the head of the wearer, and first holes 210 formed on the inner housings 200 are formed in a curved shape corresponding to the leg parts so that the leg parts may enter and exit the first holes 210.

Further, second holes 310 formed on the outer housings 300 are formed in a curved shape corresponding to the leg parts so that the leg parts combined with the first holes 210 may enter and exit the second holes 310 and be rotated by a designated angle upward and downward. That is, the inner housings 200 and the outer housings 300 are also curved so as to correspond to the shape of the leg parts, thus allowing the detachable safety goggles for safety helmets to be smoothly operated without friction between the frame 100 and the inner and outer housings 200 and 300.

As described above, the detachable safety goggles for safety helmets in accordance with the present invention may be simply attached to and detached from a safety helmet and the wearing distance and angle of the detachable safety goggles for safety helmets with a worker may be conveniently adjusted as the worker desires. Further, the detachable safety goggles for safety helmets may rotate a lens upward and downward, thus being more conveniently used.

As apparent from the above description, the present invention provides detachable safety goggles for safety helmets which may be simply attached to and detached from a safety helmet and the wearing distance and angle of the detachable safety goggles for safety helmets with a worker may be conveniently adjusted as the worker desires, thus being more conveniently used.

Further, the detachable safety goggles for safety helmets in accordance with the present invention may rotate a lens upward and downward, thus being more conveniently used.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. Detachable safety goggles for safety helmets comprising:

a frame provided with a lens mounted at the front part thereof and rack gears formed in the forward and backward directions at both leg parts thereof;

inner housings, each of which is formed in a cylindrical shape, at least one end surface of which is opened, and is provided with first holes formed through the side surface thereof so that each of leg parts may enter and exit each of the inner housings through the first holes, and first snap protrusions formed on the inner surface contacting the at least one opened end surface;

outer housings, each of which is formed in a cylindrical shape, one end surface of which is closed and the other end surface of which is opened, and is provided with second holes formed through the side surface thereof so that each of the leg parts combined with the first holes may enter and exit each of the outer housings through the second holes and be rotated by a designated angle upward and downward, and a first snap gear corresponding to the first snap protrusions of each of the inner housings and formed on the closed end surface, a rotation shaft hole being formed through the center of the first snap gear;

rotating handles, each of which is combined with the rotation shaft hole of each of the outer housings and is provided with a pinion gear formed at the end thereof inserted into each of the outer housings so as to be engaged with each of the rack gears; and holders, each of which is combined with the upper end of each of the outer housings and is combined with the frame of a safety helmet.

2. The detachable safety goggles for safety helmets according to claim 1, wherein a coupling unit to combine each of the outer housings and each of the holders includes:

a rotating protrusion formed in a flat disc shape by cutting both sides of a sphere; and a rotating hole provided with a spherical inner space corresponding to the rotating protrusion.

3. The detachable safety goggles for safety helmets according to claim 1, wherein a coupling unit to combine each of the outer housings and each of the holders is configured such that each of the outer housing is rotatable in the leftward and rightward directions (in the inward and outward directions of the safety helmet) so as to correspond to the size and shape of the safety helmet.

4. The detachable safety goggles for safety helmets according to claim 1, wherein:

a second snap gear is combined with the center of the front part of the frame;

rotating shafts are formed at both sides of the second snap gear; and a mounting member including slots formed at both sides of the front part of the mounting member so that the lens may be inserted into the slots, rings formed at both sides of the rear part of the mounting member and inserted into the rotating shafts so as to be rotated, and a second snap protrusion corresponding to the second snap gear and formed between the rings is provided.

5. The detachable safety goggles for safety helmets according to claim 4, wherein the mounting member further includes:

a groove formed between the rings;

a coil spring inserted into the groove; and a pusher provided with a second snap protrusion formed on the rear end surface thereof pusher under the condition that the pusher is inserted into the groove.

6. The detachable safety goggles for safety helmets according to claim 1, wherein:

both leg parts of the frame are curved in the inward direction of the head of a user;

the first holes formed on each of the inner housings are formed in a curved shape corresponding to the leg parts so that each of the leg parts may enter and exit the first holes; and the second holes formed on each of the outer housings are formed in a curved shape corresponding to the leg parts so that each of the leg parts combined with the first holes may enter and exit the second holes and be rotated by a designated angle upward and downward.

* * * * *